US008689878B2

(12) United States Patent
Xu et al.

(10) Patent No.: US 8,689,878 B2
(45) Date of Patent: Apr. 8, 2014

(54) JUNK BASKET WITH SELF CLEAN ASSEMBLY AND METHODS OF USING SAME

(75) Inventors: Ying Qing Xu, Tomball, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 192 days.

(21) Appl. No.: 13/342,260

(22) Filed: Jan. 3, 2012

(65) Prior Publication Data

US 2013/0168091 A1 Jul. 4, 2013

(51) Int. Cl.
*E21B 31/08* (2006.01)

(52) U.S. Cl.
USPC ..... 166/312; 166/99; 166/205; 166/74; 166/105.1; 166/227; 166/311; 175/312; 175/314; 175/57

(58) Field of Classification Search
USPC ..... 166/99, 205, 105.1, 74, 227, 311, 236; 175/312, 314
See application file for complete search history.

(56) References Cited

U.S. PATENT DOCUMENTS

| | | | | |
|---|---|---|---|---|
| 2,787,327 | A | | 4/1957 | Pearson et al. |
| 2,894,725 | A | | 7/1959 | Baker |
| 3,023,810 | A | | 3/1962 | Anderson |
| 3,332,497 | A | | 7/1967 | Page, Jr. |
| 3,360,048 | A | | 12/1967 | Watkins |
| 3,500,933 | A | | 3/1970 | Burba, Jr. et al. |
| 4,059,155 | A | | 11/1977 | Greer |
| 4,217,966 | A | | 8/1980 | Garrett |
| 4,237,978 | A | * | 12/1980 | Calderon et al. ..... 166/311 |
| 4,276,931 | A | | 7/1981 | Murray |
| 4,335,788 | A | | 6/1982 | Murphey et al. |
| 4,390,064 | A | | 6/1983 | Enen, Jr. et al. |
| 4,515,212 | A | | 5/1985 | Krugh |
| 4,588,243 | A | | 5/1986 | Ramsey et al. |
| 4,828,026 | A | | 5/1989 | Nelson |

(Continued)

FOREIGN PATENT DOCUMENTS

| | | |
|---|---|---|
| CN | 2883658 Y | 3/2007 |
| GB | 2348226 A | 9/2000 |

(Continued)

OTHER PUBLICATIONS

Don M. Hannegan, et al., Technologies Manage Well Pressures, The American Oil & Gas Reporter, Sep. 2001, pp. 87-93, National Publishers Group Inc., U.S.A.

(Continued)

*Primary Examiner* — Jennifer H Gay
*Assistant Examiner* — George Gray
(74) *Attorney, Agent, or Firm* — Steve Rosenblatt

(57) ABSTRACT

A downhole tool for removing debris from fluid flowing through the downhole tool uses a screen member and wiper member, the wiper member having at least one window disposed through the inner and outer wall surfaces of the wiper member. Either the screen member or the wiper member is rotatable such that rotation of the screen member or the wiper member causes debris disposed on the outer wall surface of the screen member to fall-off the screen member. At least one directional port disposed at either the upper end of the screen member or the upper end of the wiper member causes rotation of the screen member or wiper member when fluid flows through the downhole tool.

12 Claims, 6 Drawing Sheets

(56) References Cited

U.S. PATENT DOCUMENTS

| | | | |
|---|---|---|---|
| 4,857,175 | A | 8/1989 | Spinnler |
| 4,880,059 | A | 11/1989 | Brandell et al. |
| 5,228,518 | A | 7/1993 | Wilson et al. |
| 5,425,424 | A | 6/1995 | Reinhardt et al. |
| 5,524,709 | A | 6/1996 | Withers |
| 5,533,373 | A | 7/1996 | Plester |
| 6,112,812 | A | 9/2000 | Carter |
| 6,179,057 | B1 | 1/2001 | Fontana et al. |
| 6,202,752 | B1 | 3/2001 | Kuck et al. |
| 6,276,452 | B1 | 8/2001 | Davis et al. |
| 6,341,653 | B1 | 1/2002 | Firmaniuk et al. |
| 6,352,129 | B1 | 3/2002 | Best |
| 6,361,272 | B1 | 3/2002 | Bassett |
| 6,397,959 | B1 | 6/2002 | Villarreal |
| 6,427,776 | B1 | 8/2002 | Hoffman et al. |
| 6,446,737 | B1 | 9/2002 | Fontana et al. |
| 6,543,538 | B2 | 4/2003 | Tolman et al. |
| 6,568,475 | B1 | 5/2003 | Grubb et al. |
| 6,607,031 | B2 | 8/2003 | Lynde et al. |
| 6,655,459 | B2 | 12/2003 | Mackay |
| 6,719,071 | B1 | 4/2004 | Moyes |
| 6,755,256 | B2 | 6/2004 | Murley et al. |
| 6,951,251 | B2 | 10/2005 | Penisson |
| 7,069,992 | B2 | 7/2006 | Lewis et al. |
| 7,096,975 | B2 | 8/2006 | Aronstam et al. |
| 7,114,581 | B2 | 10/2006 | Aronstam et al. |
| 7,174,975 | B2 | 2/2007 | Krueger et al. |
| 7,267,172 | B2 | 9/2007 | Hofman |
| 7,478,687 | B2 | 1/2009 | Lynde et al. |
| 7,497,260 | B2 | 3/2009 | Telfer |
| 7,513,303 | B2 | 4/2009 | Hern |
| 7,610,957 | B2 | 11/2009 | Davis et al. |
| 7,721,822 | B2 | 5/2010 | Krueger et al. |
| 7,753,113 | B1 | 7/2010 | Penisson |
| 7,806,203 | B2 | 10/2010 | Krueger et al. |
| 7,861,772 | B2 | 1/2011 | Blair |
| 7,987,901 | B2 | 8/2011 | Krueger et al. |
| 8,011,450 | B2 | 9/2011 | Krueger et al. |
| 2001/0050185 | A1 | 12/2001 | Calder et al. |
| 2003/0098181 | A1 | 5/2003 | Aronstam et al. |
| 2004/0251033 | A1 | 12/2004 | Cameron et al. |
| 2010/0243258 | A1 | 9/2010 | Fishbeck et al. |
| 2011/0024119 | A1 | 2/2011 | Wolf et al. |
| 2011/0203848 | A1 | 8/2011 | Krueger et al. |
| 2012/0160503 | A1 | 6/2012 | Davis |

FOREIGN PATENT DOCUMENTS

| | | |
|---|---|---|
| WO | WO 99/22112 | 5/1999 |
| WO | WO 00/04269 | 1/2000 |
| WO | WO 00/08295 | 2/2000 |
| WO | WO 03/006778 A1 | 1/2003 |
| WO | WO 03/025336 A1 | 3/2003 |

OTHER PUBLICATIONS

Anthony Hill and William Furlow, New Tool Addresses ECD Problem, Offshore, Jun. 2002, pp. 88-89, U.S.A., retrieved May 14, 2012, from http://www.pennenergy.com/index/petroleum/display/149477/articles/offshore/volume-62/issue-6/departments/drilling-production/new-tool-addresses-ecd-problem.html, pp. 1-3.

P.A. Bern, et al., A New Downhole Tool for ECD Reducton, Feb. 19, 2003, pp. 1-4, SPE/IADC 79821, Society of Petroleum Engineers Inc., U.S.A.

Sven Krüger, TurboLift Advanced ECD Control, Apr. 2005, pp. 1-13, Baker Hughes Incorporated/INTEQ, U.S.A.

* cited by examiner

JUNK BASKET WITH SELF CLEAN ASSEMBLY AND METHODS OF USING SAME

BACKGROUND

1. Field of Invention

The invention is directed to a downhole clean-up tool for use in oil and gas wells, and in particular, to a downhole clean-up tool that is capable of self-cleaning debris out of the flow path so that the tool can continue to operate for a longer period of time.

2. Description of Art

Downhole tools for clean-up of debris in a wellbore are generally known and are referred to as "junk baskets." In general, the junk baskets have a screen or other structure that catches debris within the tool as fluid flows through the tool. This occurs because the fluid carrying the debris flows through the tool such that at a point in the flow path, the speed of the fluid flowing through the tool decreases such that the junk or debris falls out of the flow path and into a basket or screen.

SUMMARY OF INVENTION

Broadly, downhole tools for clean-up of debris within a well comprise a screen member and a wiper member in sliding engagement with each other to wipe away debris that might be caught in the screen member. The wiper member can be disposed in sliding engagement with the downstream or outer wall surface of the screen member, or in sliding engagement with the upstream or inner wall surface of the screen member. The wiper member also includes one or more window to allow periodic blocking of fluid flow through the screen member during operation of the downhole tools.

In certain specific embodiments, the wiper member includes one or more directional flow ports through one end of the wiper member to facilitate rotation of the wiper member relative to the screen member. In other specific embodiments, the screen member includes one or more directional flow ports through one end of the screen member to facilitate rotation of the screen member relative to the wiper member.

Figure 1:
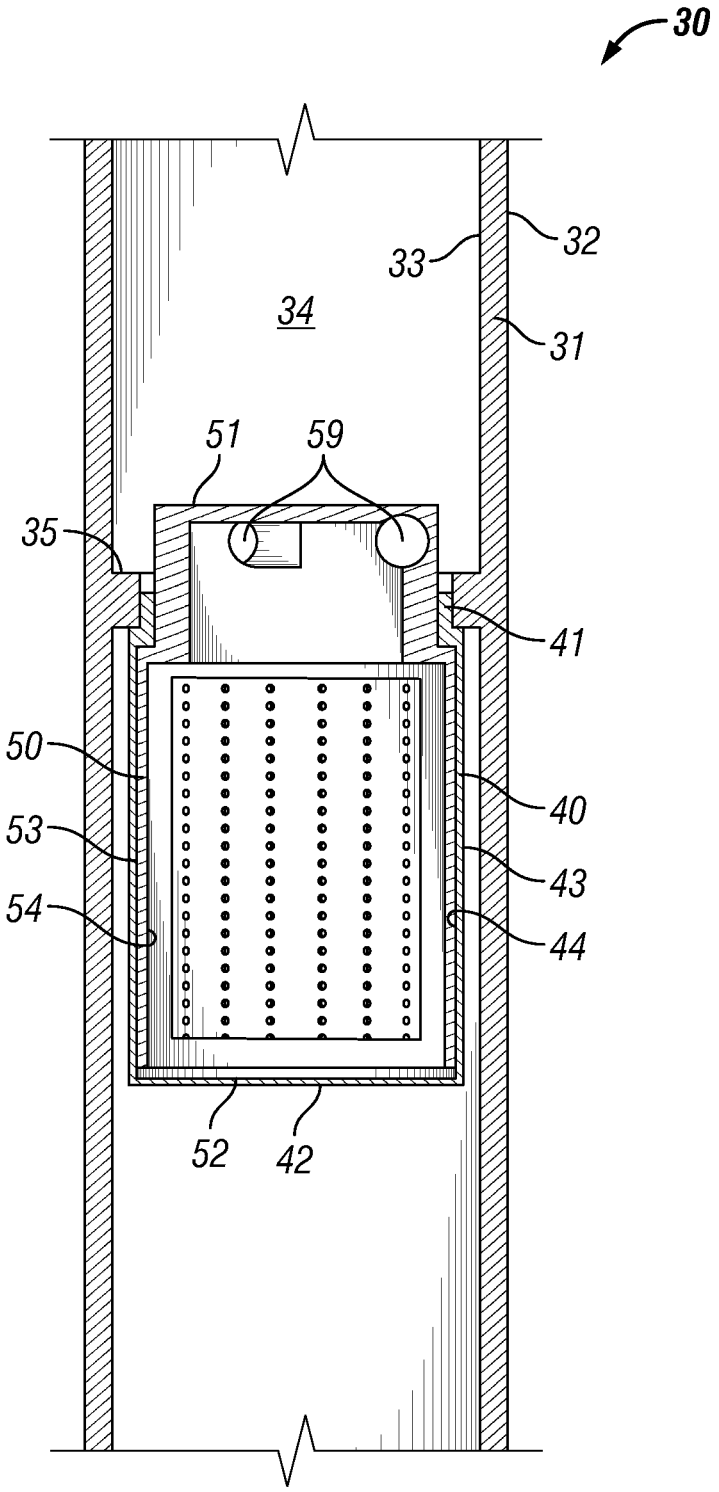
FIG. 1 is a partial cross-sectional view of a specific embodiment of a downhole tool disclosed herein.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-4, in one particular embodiment, downhole tool 30 comprises tubular member 31 having outer wall surface 32, and inner wall surface 33 defining longitudinal bore 34. Disposed within bore 34 is screen member 40 and wiper member 50. In the particular embodiment of FIGS. 1-4, screen member 40 is secured within bore 34 by flange 35 formed by inner wall surface 33. It is to be understood, however, that flange 35 is not required to secure screen member 40 within bore 34. Any other device or method known in the art can be used to secure screen member 40 within bore 34.

Figure 2:
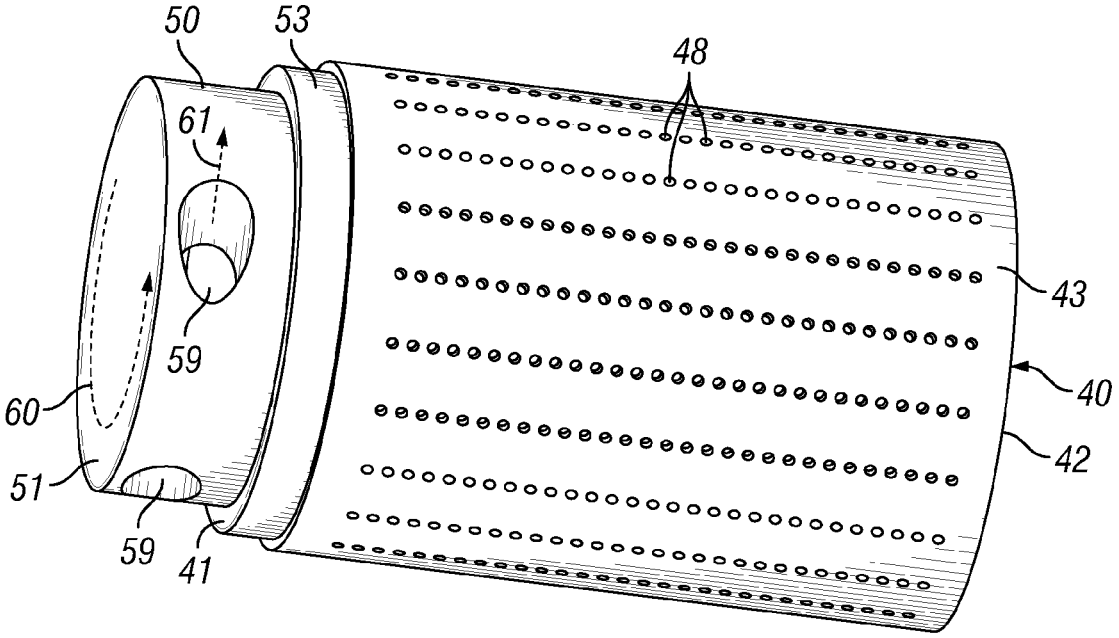
FIG. 2 is a perspective view of an embodiment of a screen member and an embodiment of a wiper member of the downhole tool shown in FIG. 1.
Figure 4:
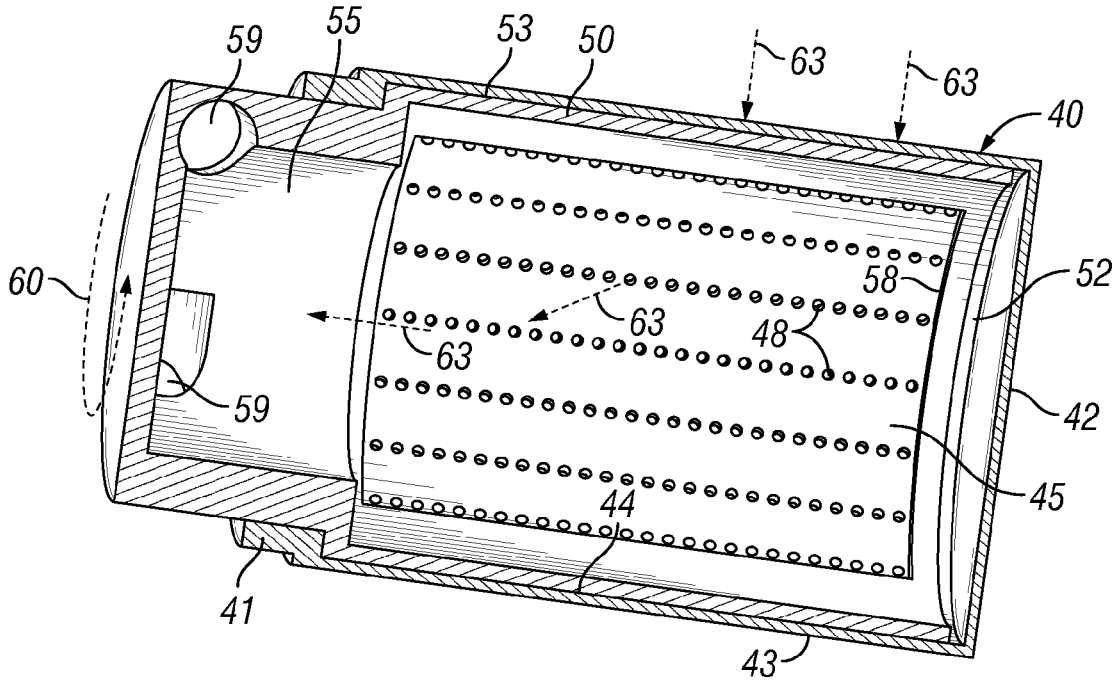
FIG. 4 is partial cross-sectional view of an embodiment of the screen member and the wiper member shown in FIGS. 1 and 2 showing a flow path through the screen member and the wiper member.
Figure 5:
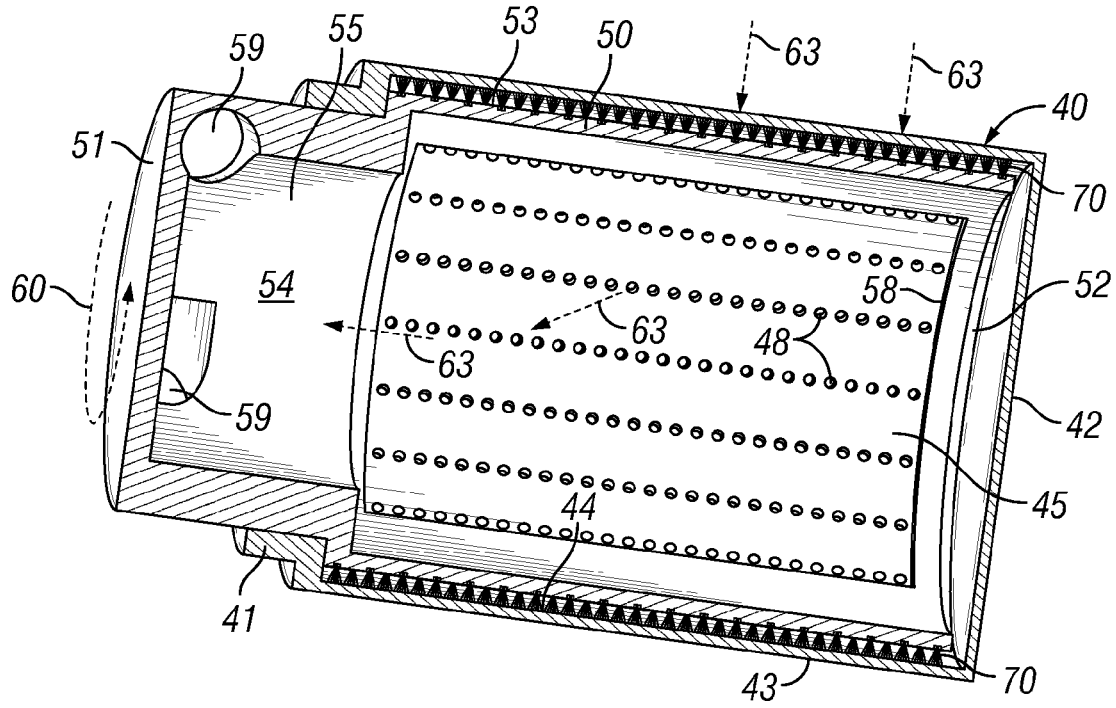
FIG. 5 is partial cross-sectional view of another embodiment of a screen member and wiper member of a downhole tool disclosed herein.

Screen member 40 comprises upper end 41, lower end 42, upstream or outer wall surface 43, downstream or inner wall surface 44 defining screen bore 45 (FIG. 4), and a plurality of apertures 48 (FIGS. 2, 4, and 5). Although screen member 40 is shown has having a plurality of apertures 48, it is to be understood that screen member 40 can have as few as one aperture 48. As shown in FIG. 4, in this particular embodiment, lower end 42 is closed and upper end 41 is opened to receive wiper member 50.

Figure 3:
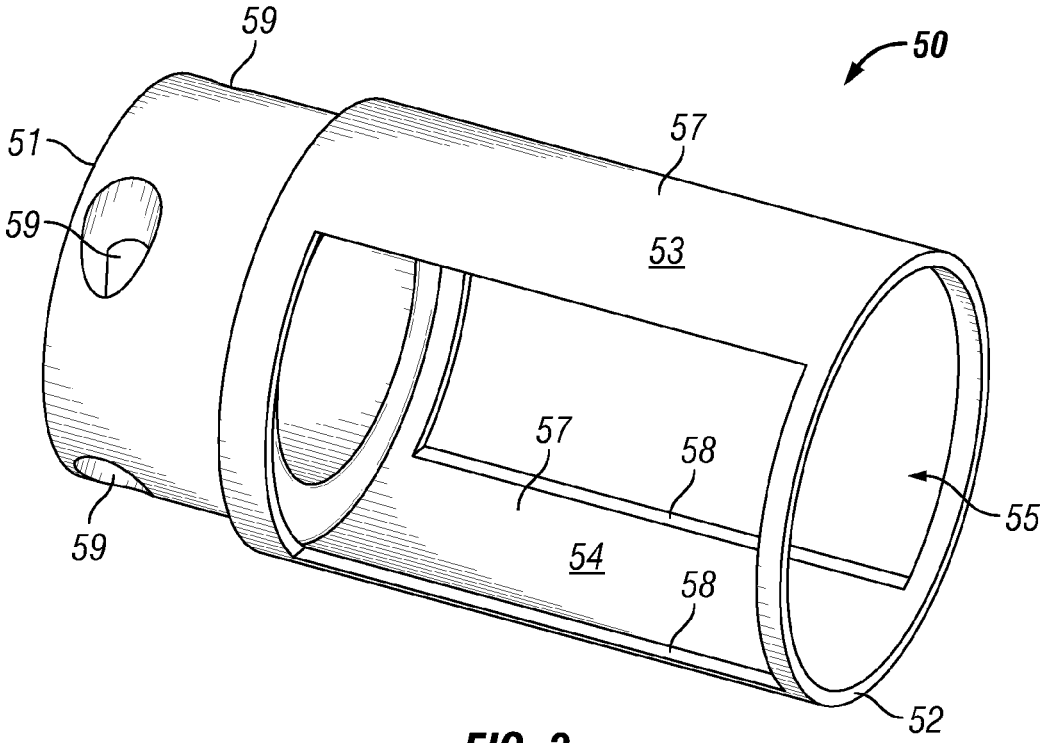
FIG. 3 is a perspective view of an embodiment of the wiper member shown in FIGS. 1 and 2.

Wiper member 50 comprises upper end 51, lower end 52, upstream or outer wall surface 53, downstream or inner wall surface 54 defining wiper bore 55 (FIGS. 3, 4, and 5), and two windows 58 (FIG. 3). Outer wall surface 53, inner wall surface 54, and windows 58 define wiper blades 57. Wiper blades 57 can be straight (as shown in FIG. 3), curved (not shown), or any other layout or design desired or necessary to facilitate operation of downhole tool 30. In the embodiment of FIGS. 1-4, upper end 51 is closed and lower end 52 is opened. Disposed at upper end 51 are directional ports 59. Directional ports 59 facilitate rotation of wiper member 50 so that outer wall surface 53 of wiper member 50 is in sliding engagement with inner wall surface 44 of screen member 40. Directional ports 59 can be in any size, shape, or pattern as long as when fluid is flowing through directional ports 59, wiper member 50 rotates.

The term "downstream wall surface" as used herein means the wall surface after the fluid has passed through the screen member or the wiper member and the term "upstream wall surface" as used herein means the wall surface before the fluid has passed through the screen member or the wiper member.

Screen member 40 and wiper member 50 can be formed out of any desired or necessary material to facilitate catching and wiping away debris. In one embodiment, both screen member 40 and wiper member 50 are formed of metal such as steel. In another embodiment, wiper member 50 is formed of a non-metallic material to reduce weight.

Referring now to FIG. 5, in one specific embodiment of downhole tool 30 described above with respect to FIGS. 1-4, inner wall surface 54 comprises a plurality of bristles or brush members 70. As discussed in greater detail below, brush member(s) 70 facilitate(s) removal of debris disposed along inner wall surface 43 of screen member 40.

Although brush members 70 are shown disposed uniformly over the entire inner wall surface 54, it is to be understood that brush members 70 can be distributed along inner wall surface 54 in any arrangement and can be limited to as few as one brush member 70.

In operation, downhole tool 30 is included as part of a tubing or work string that is then disposed within a wellbore. Conventional fluid circulation down through the work string is utilized to perform a reverse circulating action downhole to collect debris such as metal cuttings and other junk. The circulation of fluid through the work string flows debris upward through downhole tool 30. The fluid passes through apertures 48 into bore 45 of screen member 40. Apertures 48 allow the fluid to pass through screen member 40 (as indicated by arrows 63 (FIGS. 4 and 5) causing debris to be captured along outer wall surface 43 of screen member 40. In some instances, the debris will fall downward into a basket (not shown) disposed below screen member 40 due to the force of gravity being greater than the force of the fluid flowing upward. This occurs because, even though the fluid circulation rate needs to be increased to pick up large size debris, the pressure drop across screen member 40 caused by the fluid flow rate causes smaller sized debris to stick to outer wall surface 43 of screen member 40 causing circulation to become restricted such that the larger debris falls downward. To prevent the likelihood that all circulation is cut-off by the smaller debris, wiper member 50 is rotated within screen bore 45 restricting fluid flow through one or more of apertures 48. As wiper blade(s) 57 rotate, a portion of apertures 48 are periodically no longer in fluid communication with screen bore 45 causing the pressure drop across apertures 48 to lessen or disappear which, in turns, causes the debris to fall-off of outer wall surface 43. As wiper member 40 is rotated, fluid flow is reestablished through the previously restricted apertures 48 and continued downhole clean-up can proceed without further intervention. In embodiments in which brush members 70 are present, brush members 70 facilitate removal of debris along outer wall surface 43 such as by temporarily being disposed through apertures 48 to push debris out of apertures 48.

As shown in the embodiment of FIGS. 1-5, fluid flowing through apertures 48 and through windows 58 enters wiper bore 55 and then flows out of directional ports 59 as indicated by arrow 61 (FIG. 2). Due to the orientation of directional ports 59, wiper member 40 is rotated as indicated by arrow 60 (FIGS. 2, 4, and 5) within screen bore 45 such that outer wall surface 53 of wiper member 50 is in sliding engagement with inner wall surface 44 of screen member 40.

Figure 6:
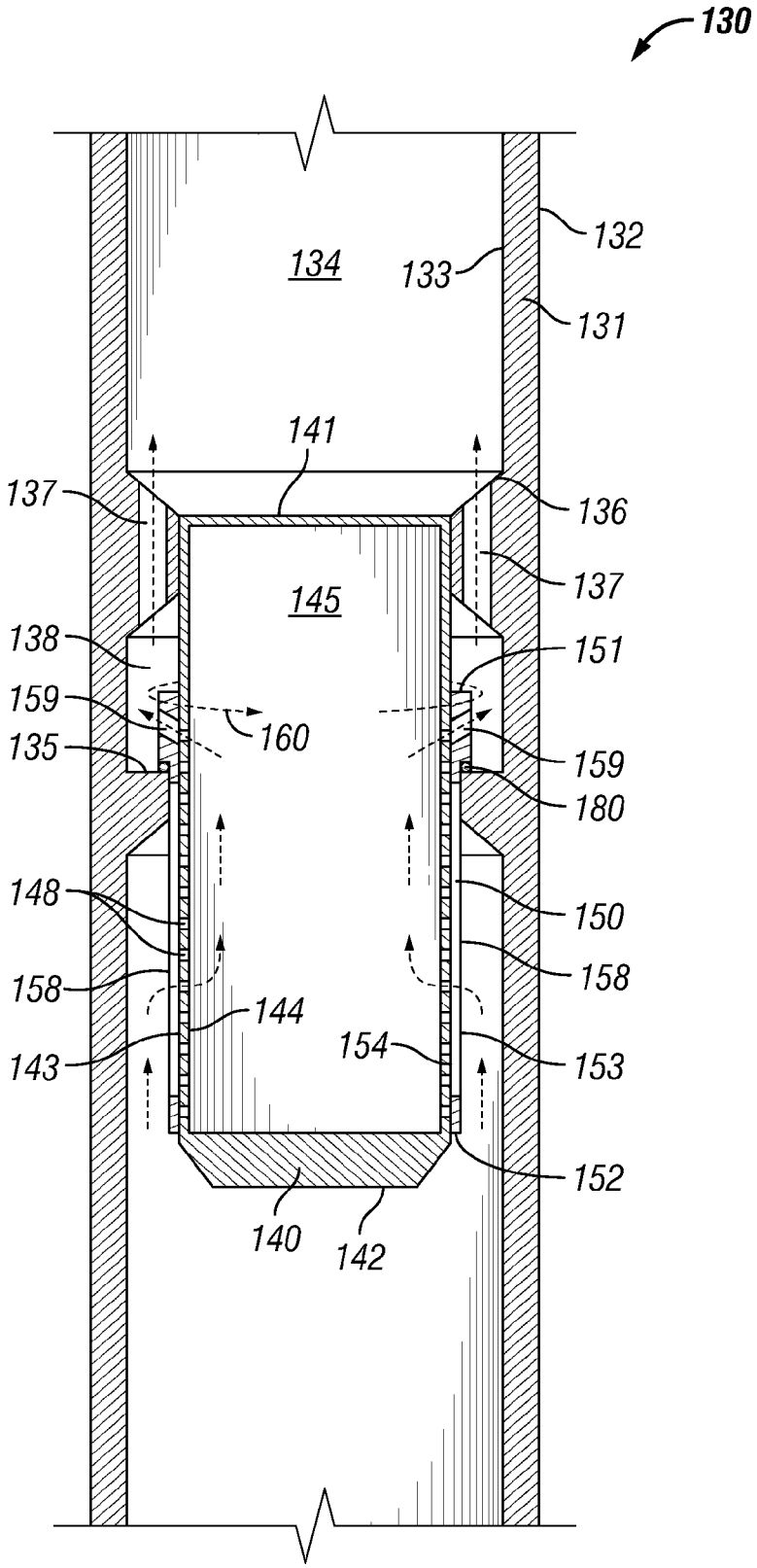
FIG. 6 is a cross-sectional view of another embodiment of a downhole tool disclosed herein.

Referring now to FIG. 6, in another specific embodiment, downhole tool 130 comprises tubular member 131 having outer wall surface 132, inner wall surface 133 defining longitudinal bore 134. Disposed within bore 134 is screen member 140 and wiper member 150. In the particular embodiment of FIG. 6, screen member 140 is secured within bore 134 by flange 136 formed by inner wall surface 133. It is to be understood, however, that flange 136 is not required to secure screen member 140 within bore 134. Any other device or method known in the art can be used to secure screen member 140 within bore 134.

Screen member 140 comprises upper end 141, lower end 142, outer wall surface 143, inner wall surface 144 defining screen bore 145, and a plurality of apertures 148. Although screen member 140 is shown has having a plurality of apertures 148, it is to be understood that screen member 140 can have as few as one aperture 148. Upper end 141 and lower end 142 are closed.

Wiper member 150 comprises upper end 151, lower end 152, outer wall surface 153, inner wall surface 154 defining the wiper bore, and windows 158. Outer wall surface 153, inner wall surface 154, and windows 158 define wiper blades (not shown) in the same manner as described above with respect to wiper member 50. Upper end 151 and lower end 152 are opened so screen member 140 can extend above and below upper end 151 and lower end 152, respectively. Disposed at upper end 151 are directional ports 159. Directional ports 159 facilitate rotation of wiper member 150 so that outer wall surface 143 of screen member 140 is in sliding engagement with inner wall surface 154 of wiper member 150. Directional ports 159 can be in any size, shape, or pattern as long as when fluid is flowing through directional ports 159, wiper member 150 rotates.

In the embodiment of FIG. 6, wiper member 150 is operatively associated with flange 135 formed by inner wall surface 133. Bearing 180 facilitates rotation of wiper member 150 along the upper surface of flange 135 in the direction of arrow 160.

Chamber 138 is defined by flanges 135, 136 to receive fluid flowing from directional ports 159. Passages 137 permit fluid to flow from chamber 138 through flange 136 and into bore 134 above screen member 140 and wiper member 150.

In operation, fluid flows upward in the same manner as described above with respect to the embodiment of FIGS. 1-5. In so doing, the fluid flows in the direction of the arrows shown in FIG. 6, namely, through windows 158, through apertures 148 disposed below flange 135, into bore 145, out of apertures 148 disposed above flange 135, through directional ports 159, into chamber 138, through passages 137, and into bore 134 above screen member 140 and wiper member 150. As fluid flows through this path, wiper member 150 rotates in the direction of arrow 160 causing periodic pressure drop across apertures 148 so that debris is cleaned from outer wall surface 143 of screen member 140 facilitating continued downhole clean-up without further intervention.

Figure 7:
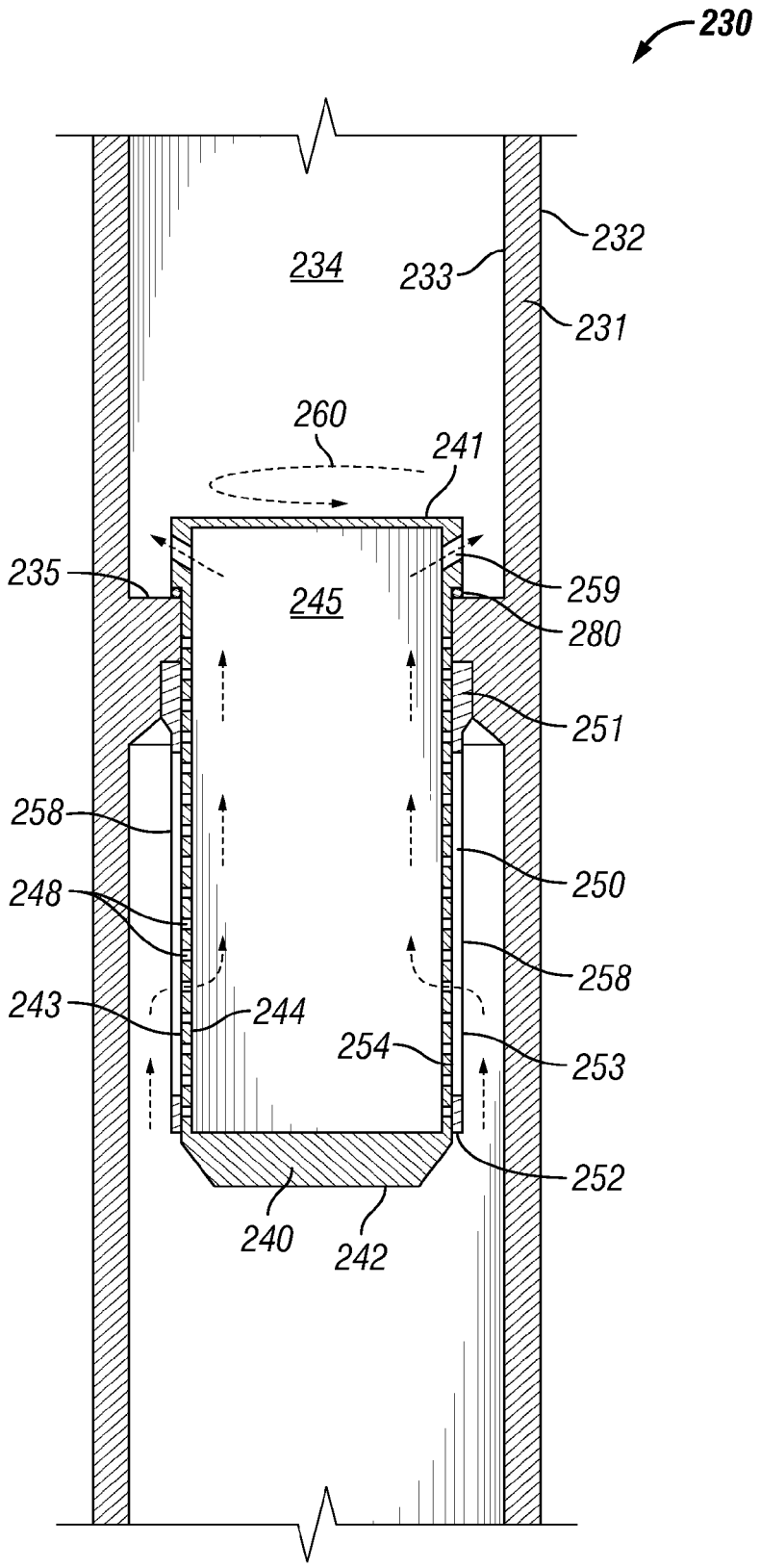
FIG. 7 is a cross-sectional view of an additional embodiment of a downhole tool disclosed herein.
Figure 8:
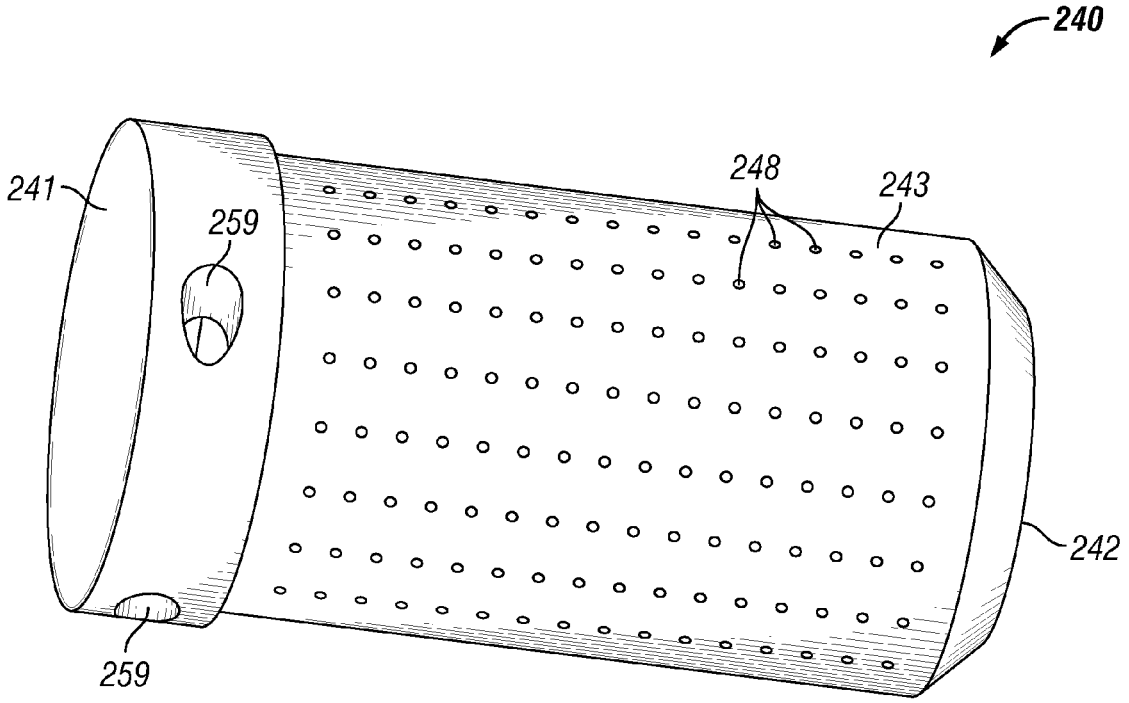
FIG. 8 is a perspective view of an additional embodiment of a screen member of the downhole tool shown in FIG. 7.

Referring now to FIGS. 7-8, in an additional embodiment, downhole tool 230 comprises tubular member 231 having outer wall surface 232, inner wall surface 233 defining longitudinal bore 234. Disposed within bore 234 is screen member 240 and wiper member 250. In the particular embodiment of FIGS. 7-8, wiper member 250 is secured within bore 234 by flange 235 formed by inner wall surface 233. It is to be understood, however, that flange 235 is not required to secure wiper member 250 within bore 134. Any other device or method known in the art can be used to secure wiper member 250 within bore 234.

Wiper member 250 comprises upper end 251, lower end 252, outer wall surface 253, inner wall surface 254 defining the wiper bore, and windows 258. Outer wall surface 253, inner wall surface 254, and windows 258 define wiper blades (not shown) in the same manner as described above with respect to wiper member 50. Upper end 251 and lower end 252 are opened so screen member 240 can extend above and below upper end 251 and lower end 252, respectively.

As shown in FIGS. 7-8, screen member 240 comprises upper end 241, lower end 242, outer wall surface 243, inner wall surface 244 (FIG. 7) defining screen bore 245 (FIG. 7), and a plurality of apertures 248. Although screen member 240 is shown has having a plurality of apertures 248, it is to be understood that screen member 240 can have as few as one aperture 248. Upper end 241 and lower end 242 are closed. Disposed at upper end 241 are directional ports 259. Directional ports 259 facilitate rotation of screen member 240 so that outer wall surface 243 of screen member 240 is in sliding engagement with inner wall surface 254 of wiper member 250. Directional ports 259 can be in any size, shape, or pattern as long as when fluid is flowing through directional ports 259, screen member 240 rotates.

In the embodiment of FIGS. 7-8, screen member 240 is operatively associated with flange 235 formed by inner wall surface 233. Bearing 280 facilitates rotation of screen member 240 along the upper surface of flange 235 in the direction of arrow 260.

In operation, fluid flows upward in the same manner as described above with respect to the embodiment of FIGS. 1-5.

In so doing, the fluid flows in the direction of the arrows shown in FIG. 7, namely, through windows 258, through apertures 248, into bore 245, through directional ports 259, and into bore 134 above screen member 240 and wiper member 250. As fluid flows through this path, screen member 240 rotates in the direction of arrow 260 causing periodic pressure drop across apertures 248 so that debris is cleaned from outer wall surface 243 of screen member 240 facilitating continued downhole clean-up without further intervention.

It is to be understood that the invention is not limited to the exact details of construction, operation, exact materials, or embodiments shown and described, as modifications and equivalents will be apparent to one skilled in the art. For example, in embodiments in which either the screen member or the wiper member is stationary, any device or method known in the art to maintain the screen member or wiper member stationary can be used. In addition, the wiper member can have as few as one window. Alternatively, the wiper member can have three or more windows. Moreover, the apertures in screen member can have any arrangement, size and dimensions as desired or necessary to restrict flow of debris through screen and to allow debris stuck on the screen member to be removed by the wiper member. Further, brush members can be included in any of the embodiments of FIGS. 1-8. Additionally, the directional ports in the embodiment of FIGS. 1-6 can be absent and instead, rotation of the wiper member can be caused by fluid flowing through one or more helical grooves disposed along the upstream or outer wall surface of the wiper member. Alternatively, rotation of wiper member can be caused by fluid flowing against one or more tilted or angled blades disposed along the upstream or outer wall surface of the wiper member.

In addition, screen member can have a flat geometric shape with the wiper member in sliding engagement with the downstream wall surface of the screen member such that the downstream wall surface is substantially horizontal to a longitudinal axis of the downhole tool. In this embodiment, the wiper can comprise a shaft with an upper end that is operatively associated with a bearing disposed on a flange member and the blades are shape to cause rotation as fluid flows through the aperture(s) of the screen member. The flange member includes one or more passages similar to passages 137 as shown in FIG. 6. Alternatively, the wiper member can be held stationary and the screen member can be rotatable on bearings disposed on the inner wall surface of the tubular member. To facilitate such rotation, the screen member can have one or more fins or other structures, such as the ones identified above, that cause screen to rotate as fluid flows through the aperture(s). Accordingly, the invention is therefore to be limited only by the scope of the appended claims.

What is claimed is:

1. A downhole tool for capturing debris flowing through the downhole tool, the downhole tool comprising:

a tubular member defining a longitudinal bore;

a screen member disposed within said tubular bore; and a wiper member having a wall disposed adjacent said screen member, the wiper member comprising at least one window disposed through said wall, at least one of said wiper member and said screen member configured to relatively rotate with respect to the other of said wiper member and said screen by virtue of flow therethrough.

2. A downhole tool for capturing debris flowing through the downhole tool, the downhole tool comprising:

a tubular member having an upper end, a lower end, an outer wall surface, an inner wall surface defining a longitudinal bore;

a screen member having a screen bore, said screen member disposed within the tubular bore, the screen member having a screen upstream wall surface, a screen downstream wall surface, and at least one aperture disposed through the screen upstream wall surface and the screen downstream wall surface; and a rotatable wiper member disposed within said screen bore, the wiper member having a wiper upstream wall surface in sliding engagement with the screen downstream wall surface, a wiper downstream wall surface, and at least one window disposed through the wiper upstream wall surface and the wiper downstream wall surface;

said wiper member further comprises an upper end having at least one directional port disposed through said wiper upstream wall surface and said wiper downstream wall surface to facilitate rotation of the wiper member.

3. The downhole tool of claim 1, wherein said wiper comprises at least one brush member in sliding engagement with the screen member.

4. The downhole tool of claim 1, wherein said screen member is affixed to said tubular member.

5. A downhole tool for capturing debris flowing through the downhole tool, the downhole tool comprising:

a tubular member having an upper end, a lower end, an outer wall surface, an inner wall surface defining a longitudinal bore;

a screen member having a screen bore, said screen member disposed within the tubular bore, the screen member having a screen upstream wall surface, a screen downstream wall surface, and at least one aperture disposed through the screen upstream wall surface and the screen downstream wall surface; and a rotatable wiper member disposed within said screen bore, the wiper member having a wiper upstream wall surface in sliding engagement with the screen downstream wall surface, a wiper downstream wall surface, and at least one window disposed through the wiper upstream wall surface and the wiper downstream wall surface;

at least one of the at least one aperture is in fluid communication with said screen bore, said wiper downstream wall surface defines a wiper bore, said wiper member is disposed within said screen bore, and said wiper downstream wall surface is in fluid communication with said wiper bore.

6. The downhole tool of claim 5, wherein said wiper member further comprises an upper end having at least one directional port disposed through said wiper upstream wall surface and said wiper downstream wall surface in fluid communication with said wiper bore to facilitate rotation of the wiper member.

7. The downhole tool of claim 1, wherein said wiper member further comprises at least one blade for periodic blocking of fluid flow through said screen member, said blade positioned adjacent said window.

8. A method of removing debris from fluid flowing through a downhole tool, the method comprising the steps of:

(a) flowing fluid through a bore of a downhole tool, the fluid comprising debris, (b) passing the fluid through a screen disposed in the bore of the downhole tool; and (c) during step (b), wiping the screen with a wiper member by relative movement between said screen and said wiper member caused by said passing fluid.

9. The method of claim 8, wherein:

rotating said wiper member during step (c).

10. A method of removing debris from fluid flowing through a downhole tool, the method comprising the steps of:

(a) flowing fluid through a bore of a downhole tool, the fluid comprising debris, (b) passing the fluid through a screen disposed in the bore of the downhole tool; and (c) during step (b), wiping the screen with a wiper member by relative movement between said screen and said wiper member caused by said passing fluid;

rotating said wiper member during step (c);

rotating said wiper member by fluid flowing through a directional port disposed at an upper end of said wiper member.

11. The method of claim 8, comprising:

rotating said screen during step (c).

12. The method of claim 10, comprising:

rotating said screen by fluid flowing through a directional port in said screen.

* * * * *

UNITED STATES PATENT AND TRADEMARK OFFICE

CERTIFICATE OF CORRECTION

PATENT NO. : 8,689,878 B2
APPLICATION NO. : 13/342260
DATED : April 8, 2014
INVENTOR(S) : Ying Qing Xu and Yang Xu It is certified that error appears in the above-identified patent and that said Letters Patent is hereby corrected as shown below:

In the Claims

At column 5, line 56, please delete “tubular” and insert -- longitudinal --.

At column 6, line 2, please delete “tubular” and insert -- longitudinal --.

At column 6, line 28, please delete “tubular” and insert -- longitudinal --.

Signed and Sealed this
Fifteenth Day of July, 2014

Michelle K. Lee

Michelle K. Lee
*Deputy Director of the United States Patent and Trademark Office*